US007987746B2

(12) United States Patent
Chiang

(10) Patent No.: US 7,987,746 B2
(45) Date of Patent: Aug. 2, 2011

(54) ONE-WAY RATCHET TOOL

(75) Inventor: Jung-Chi Chiang, Wurih Township, Taichung County (TW)

(73) Assignee: Yocoso Corp., Taichung County (TW)

( * ) Notice: Subject to any disclaimer, the term of this patent is extended or adjusted under 35 U.S.C. 154(b) by 119 days.

(21) Appl. No.: 12/480,826

(22) Filed: Jun. 9, 2009

(65) Prior Publication Data

US 2010/0307297 A1 Dec. 9, 2010

(51) Int. Cl.
*B25B 13/46* (2006.01)
*B25B 23/16* (2006.01)

(52) U.S. Cl. ..... 81/58.3; 81/177.8

(58) Field of Classification Search ..... 81/58.3, 81/60, 177.2, 177.6, 177.8, 177.9
See application file for complete search history.

(56) References Cited

U.S. PATENT DOCUMENTS

| | | | | | |
|---|---|---|---|---|---|
| 1,320,137 | A * | 10/1919 | Gunn | 81/62 |
| 1,321,005 | A * | 11/1919 | Bowman | 81/58.3 |
| 4,030,384 | A * | 6/1977 | Newman | 81/58.3 |
| 4,939,961 | A * | 7/1990 | Lee | 81/60 |
| 5,168,782 | A * | 12/1992 | Cromwell | 81/177.2 |
| 5,595,095 | A * | 1/1997 | Hillinger | 81/58.3 |
| 5,752,418 | A * | 5/1998 | Robins | 81/177.2 |
| 5,875,692 | A * | 3/1999 | Lin | 81/58.3 |
| 6,158,308 | A * | 12/2000 | Huang | 81/58.3 |
| 6,912,934 | B2 * | 7/2005 | Liao | 81/58.3 |
| 6,928,903 | B1 * | 8/2005 | Liao | 81/58.3 |
| 7,104,165 | B2 * | 9/2006 | Chu | 81/177.8 |
| 7,281,452 | B2 * | 10/2007 | Chang | 81/60 |
| 7,424,839 | B2 * | 9/2008 | Chiang | 81/177.8 |
| 2004/0089106 | A1 * | 5/2004 | Wolfe et al. | 81/58.3 |
| 2005/0166718 | A1 * | 8/2005 | Chang | 81/60 |
| 2006/0201288 | A1 * | 9/2006 | Chen | 81/177.8 |
| 2007/0289413 | A1 * | 12/2007 | Stucky | 81/60 |

FOREIGN PATENT DOCUMENTS

TW M352429 3/2009

* cited by examiner

*Primary Examiner* — David B Thomas
(74) *Attorney, Agent, or Firm* — Alan Kamrath; Kamrath & Associates PA

(57) ABSTRACT

A tool includes a shank. A driving device is mounted on the first end of the shank and has a first ratcheting mechanism including a compartment and a plurality of first teeth in the compartment and a second ratcheting mechanism rotatably received in the compartment and including a plurality of second teeth engaged with the plurality of first teeth. The first ratcheting mechanism is rotatable relative to the second ratcheting mechanism in a single direction. The second ratcheting mechanism also includes a channel extending therein. A driving head is moveably received in the channel between two releasably fixed positions. In one position, the driving head is adapted to turn an element in a first direction. In another position, the driving head is adapted to turn the element in the second position opposite to the first position.

12 Claims, 11 Drawing Sheets

ONE-WAY RATCHET TOOL

BACKGROUND OF THE INVENTION

1. Field of the Invention

The present invention relates to a one-way ratchet tool and, in particular, to a tool including a driving member used for driving an element, with the driving element switchable between a first mode to enable the driving member to turn the element in a first direction and a second mode to enable the driving member to turn the element in a second direction opposite to the first direction.

2. Description of the Related Art

Taiwan Pat. No. M352429 discloses a quick-releasable adaptor for use with a wrench. Additionally, the adaptor is adapted to connect with a socket. Also, the wrench utilizes a one-way mechanism. Thus, the adaptor and the socket are adapted to turn an element in a first direction for tightening the element. Furthermore, the adaptor and the socket are adapted to turn the element in a second direction for loosening the element. However, it is often inconvenient and time-consuming to switch a first mode for driving in the first direction and a second mode for driving in the second direction.

The present invention is, therefore, intended to obviate or at least alleviate the problems encountered in the prior art.

SUMMARY OF THE INVENTION

According to the present invention, a tool includes a shank and a driving device mounted on a first end of the shank. The driving device includes a first ratcheting mechanism including a compartment and a plurality of first teeth in the compartment and includes a second ratcheting mechanism rotatably received in the compartment and including a plurality of second teeth engaged with the plurality of first teeth. The first ratcheting mechanism is rotatable relative to the second ratcheting mechanism in a single direction. The second ratcheting mechanism also includes a channel extending therein. A driving head is moveably received in the channel between two releasably fixed positions. In one position, the driving head is adapted to turn an element in a first direction. In another position, the driving head is adapted to turn the element in the second position opposite to the first position.

It is therefore an object of the present invention to provide a tool having a driving head switchable between a first mode with the driving head adapted to turn an element in a first direction and a second mode with the tool adapted to enable the driving member to turn the element in a second direction opposite to the first direction.

There has thus been outlined, rather broadly, the more important features of the invention in order that the detailed description thereof that follows may be better understood, and in order that the present contribution to the art may be better appreciated. There are additional features of the invention that will be described hereinafter and which will form the subject matter of the claims appended hereto.

DETAILED DESCRIPTION OF THE PREFERRED EMBODIMENT

Figure 1:
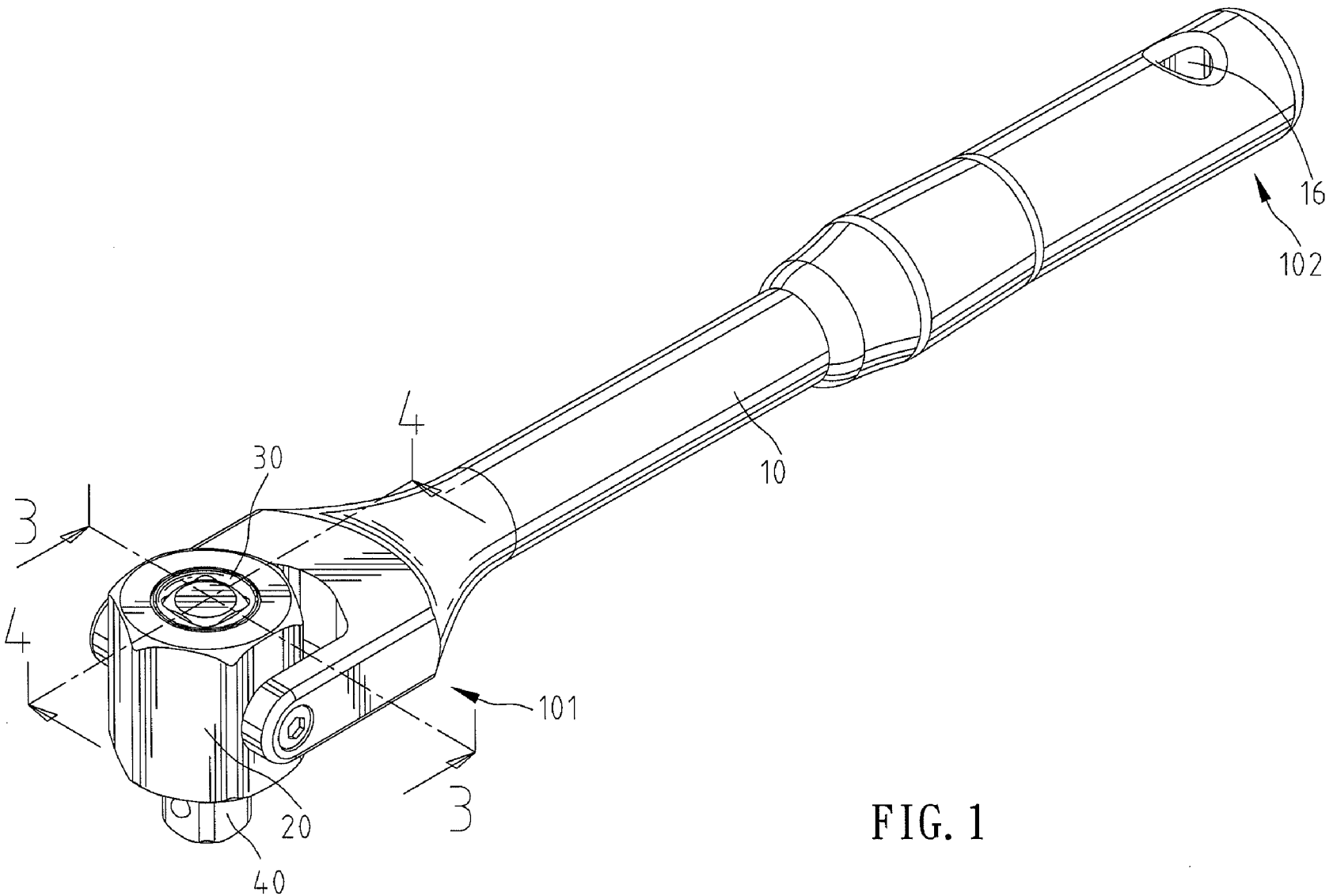
FIG. 1 is a perspective view of a tool in accordance with the present invention.
Figure 2:
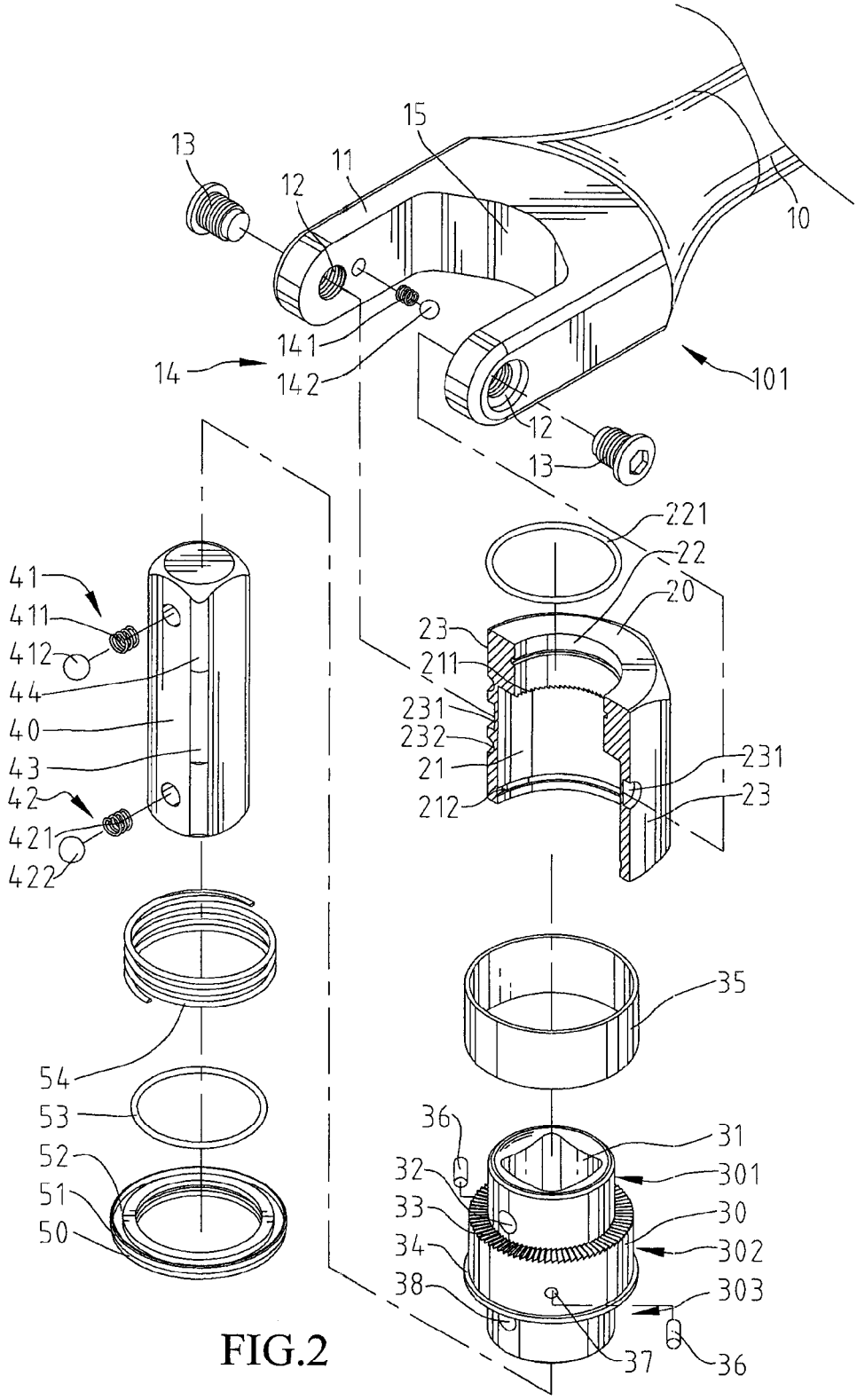
FIG. 2 is an exploded perspective view of the tool shown in FIG. 1.
Figure 3:
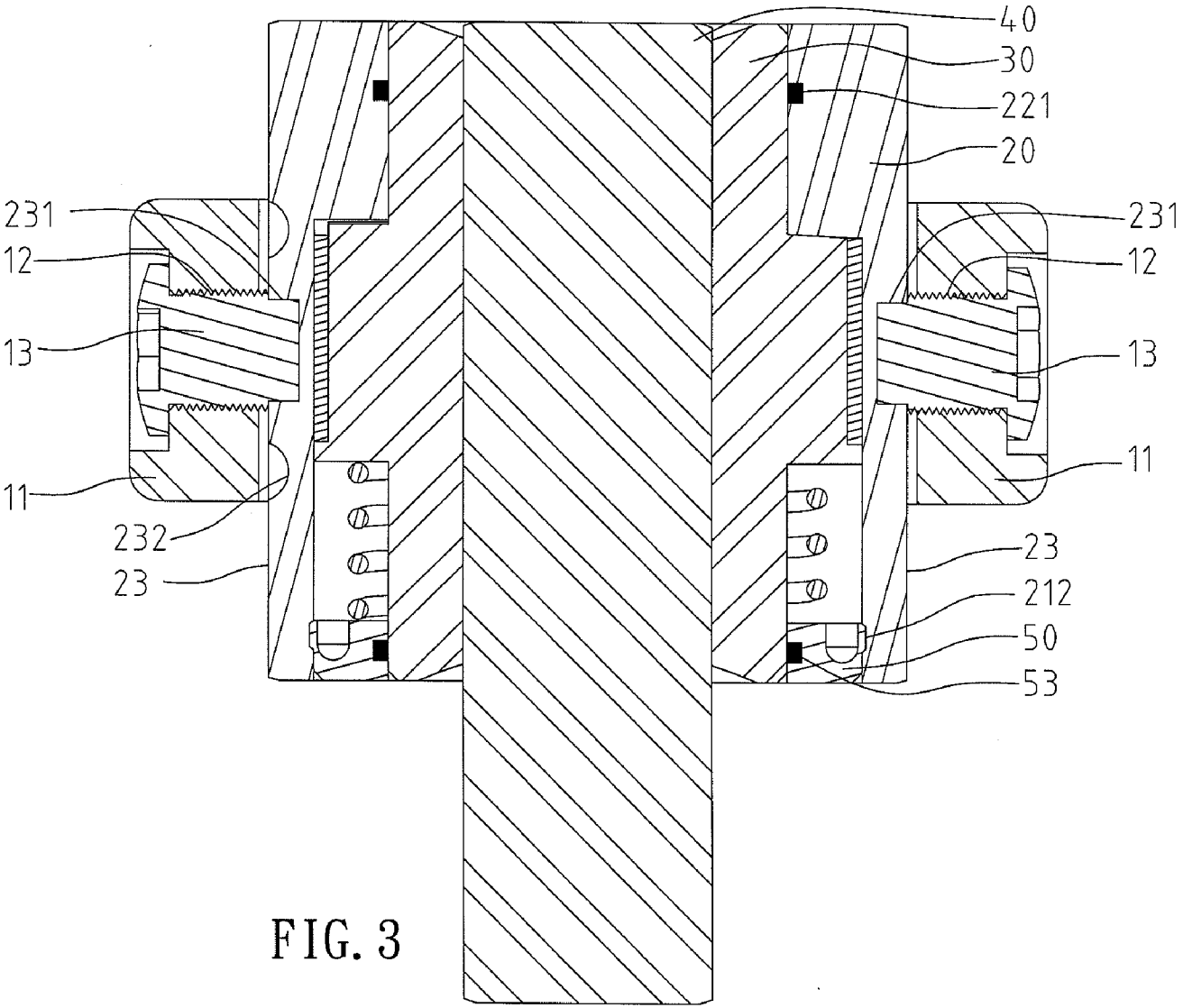
FIG. 3 is a cross-sectional view taken along line 3-3 of FIG. 1.

Referring to the drawings, a tool in accordance with the present invention includes a shank 10 and a driving device mounted on the shank 10. In the preferred embodiment, the shank 10 includes a first end 101 and a second end 102 opposite to the first end 101, and the driving device is mounted on the first end 101 of the shank 10. Further, a hole 16 is defined on the second end 102 of the shank 10, the hole 16 is adapted to receive a driving tool, and the shank 10 is adapted to be used as a lever to drive the driving tool. Likewise, the shank 10 is adapted to be used as a lever to drive the driving device or other element mounted on the driving device.

Figure 4:
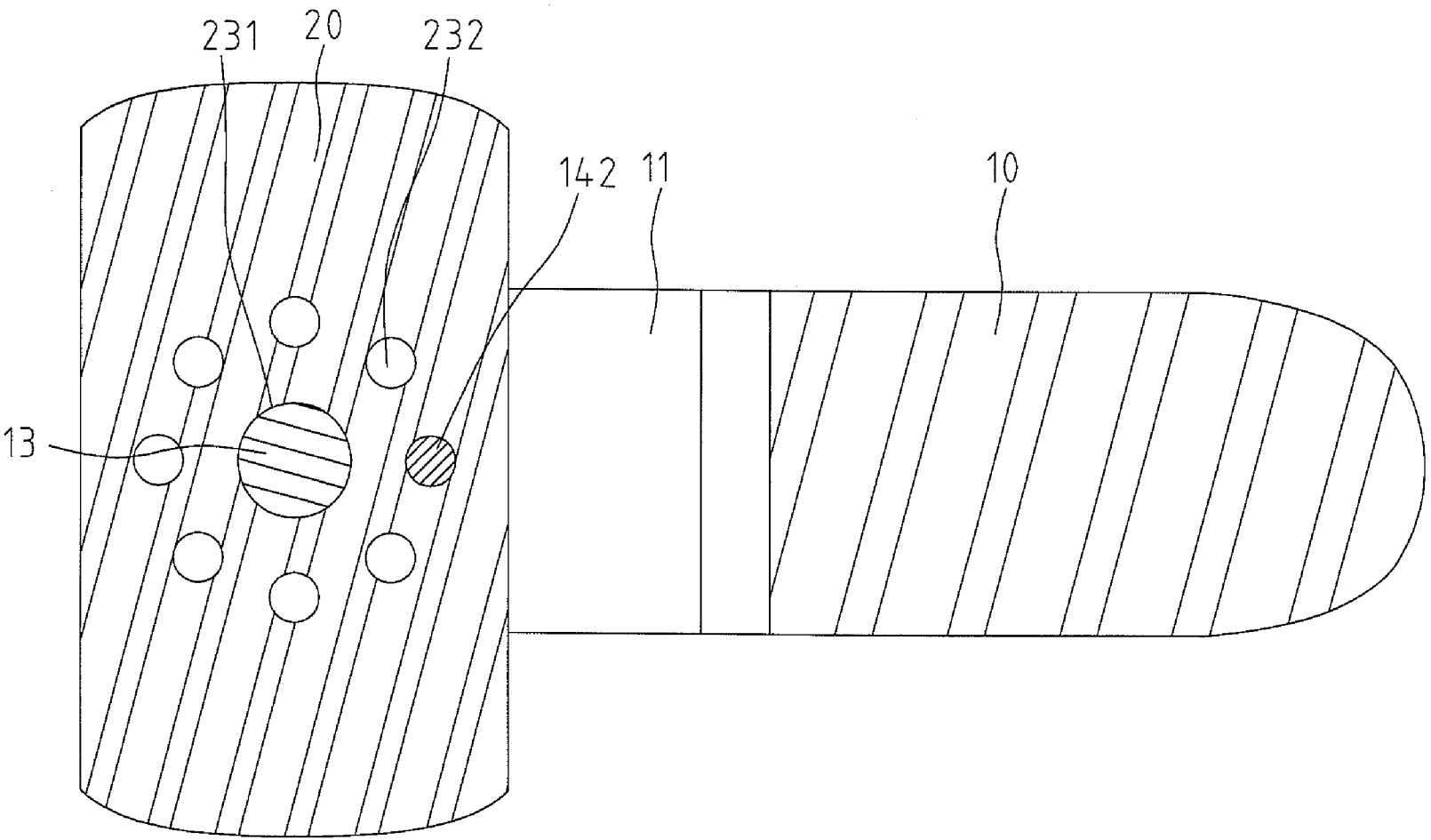
FIG. 4 is a cross-sectional view taken along line 4-4 of FIG. 1.
Figure 5:
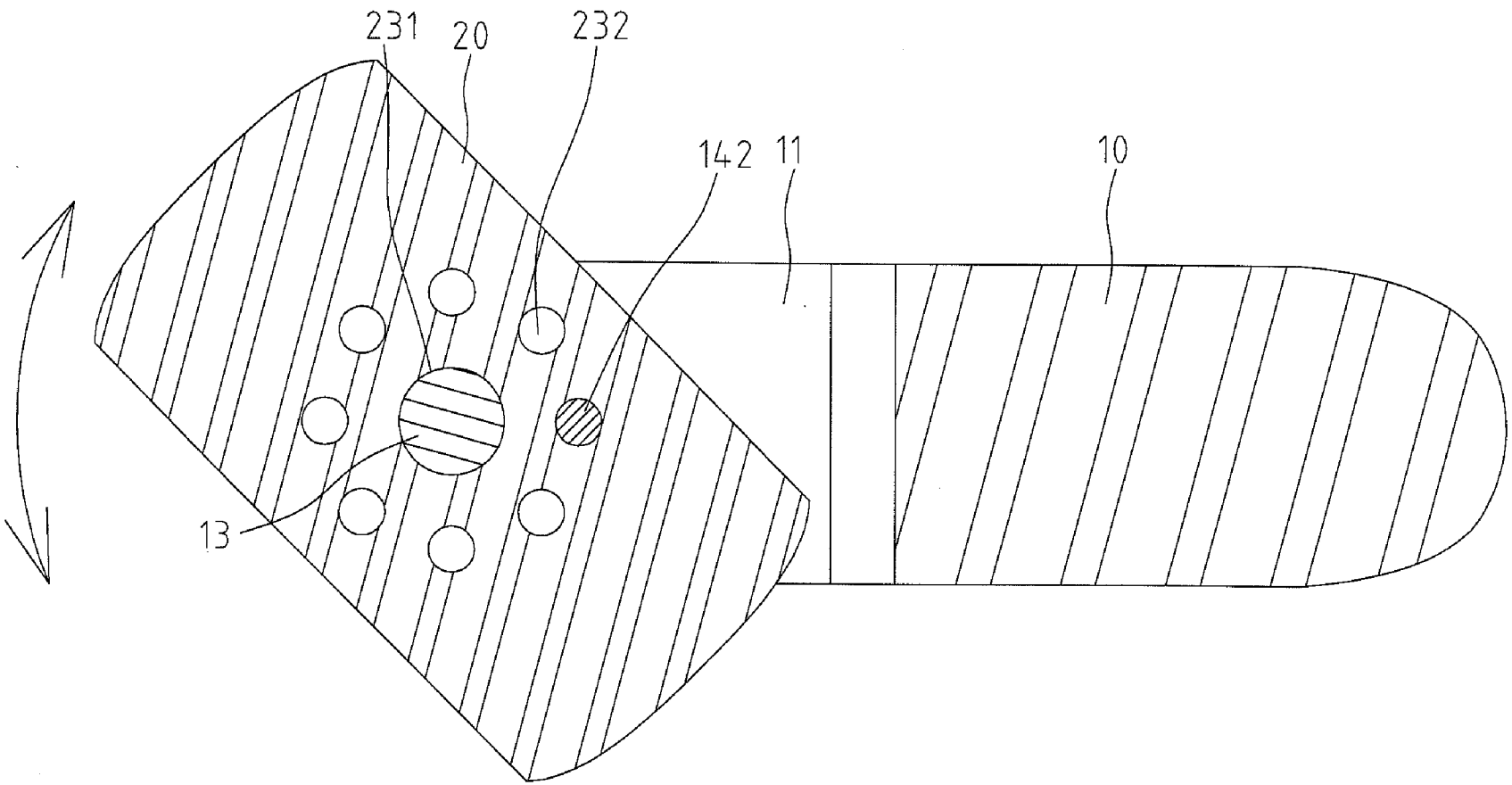
FIG. 5 is an extended view of FIG. 4 and shows the operational pivoting movement of a driving device of the tool.

The first end 101 of the shank 10 is substantially U-shaped and includes two lugs 11 separated by a substantially U-shaped space 15. The two lugs 11 clamp the driving device therebetween and hold the driving device within the space 15. Additionally, the driving device is adapted to be pivoted and positioned at a selected pivoting position, as shown in FIGS. 4 and 5. In the preferred embodiment, the two lugs 11 pivotally connect a first ratcheting mechanism 20 of the driving device therebetween and allow the first ratcheting mechanism 20 to have various releasably fixed pivoting positions. Specifically, two through holes 12 are extended in the two lugs 11 for receiving two pivot pins 13 respectively, and the first ratcheting mechanism 20 includes an outer periphery having two peripheral surfaces 23 opposed to each other and two cavities 231 disposed on the two peripheral surfaces 23 for pivotally receiving the two pivot pins 13 respectively. Thus, the first ratcheting mechanism 20 is pivotally moveable about the pivot pins 13. Further, a detent 14 is disposed in one of the two lugs 11 and includes an elastic element 141 and a locking member 142 biasably moved by the elastic element 141. Furthermore, a plurality of recesses 232 are disposed on the outer periphery of the first ratcheting mechanism 20, and the detent 14 is releasably engaged with one of the plurality of recesses 232 to retain the first ratcheting mechanism 20 at one of the selected pivoting positions. Preferably, the plurality of recesses 232 are radially disposed on the first ratcheting mechanism 20. It is understood that the reversal arrangement of the detent 14 and the plurality of recesses 232 are obvious to one skilled in the art.

The first ratcheting mechanism 20 also includes a compartment extending in a longitudinal direction of the first ratcheting mechanism 20 and through the first ratcheting mechanism 20. In the preferred embodiment, the compartment is configured of a first compartment 21 and a second compartment 22 connected and in communication with the first compartment 21. Additionally, the first compartment 21 has a larger inner diametrical length than that of the second compartment 22. Thus, the reduced diametrical length of the compartment includes a first joining section interconnecting an inner periphery of the first compartment 21 and an inner periphery of the second compartment 22. Further, a plurality of first unsymmetrical teeth 211 disposed on the first joining section.

Figure 9:
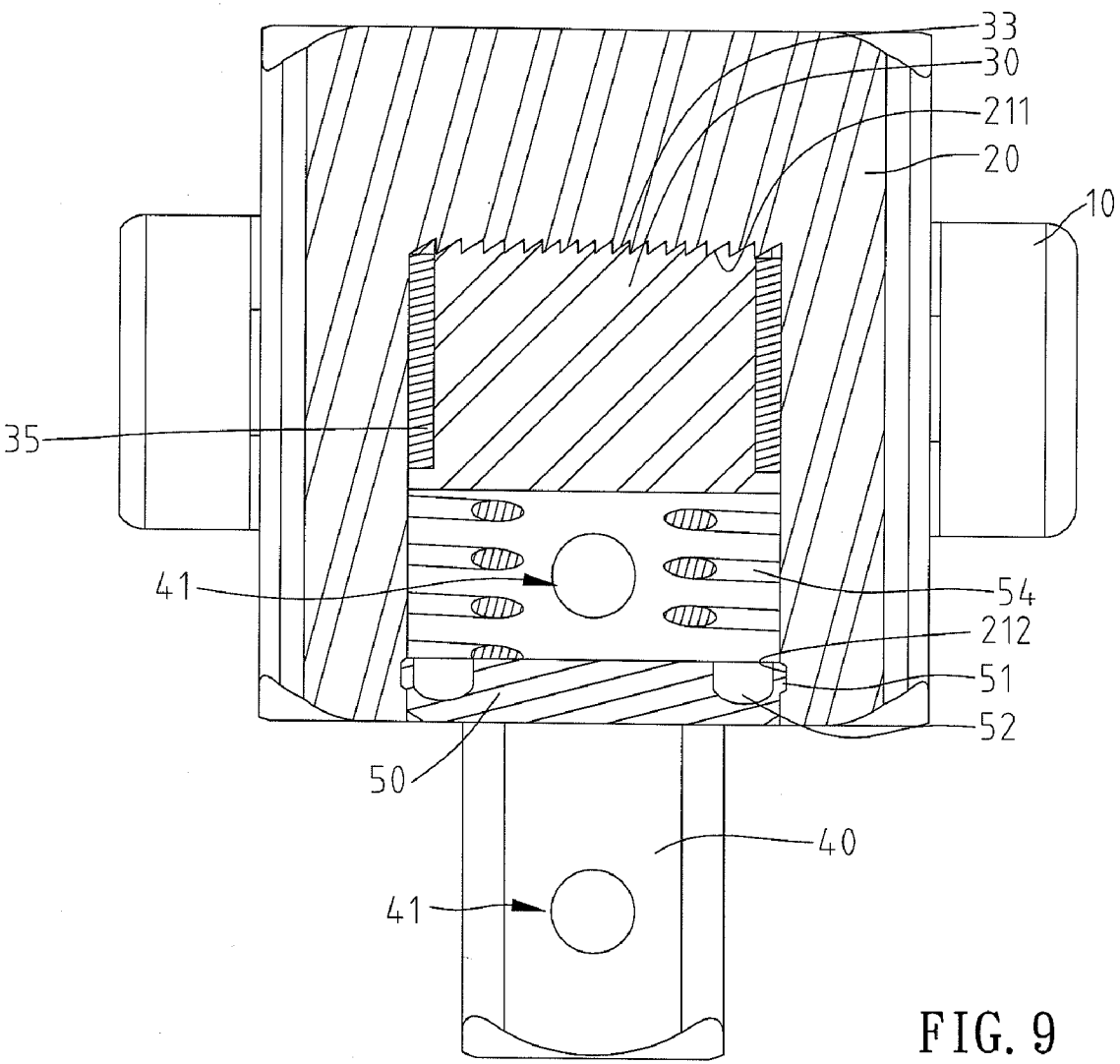
FIG. 9 is a cross-sectional view showing a first ratcheting mechanism and a second ratcheting mechanism of the driving device engaged with each other, with the first and second ratcheting mechanism each being a one-way ratcheting mechanism.
Figure 10:
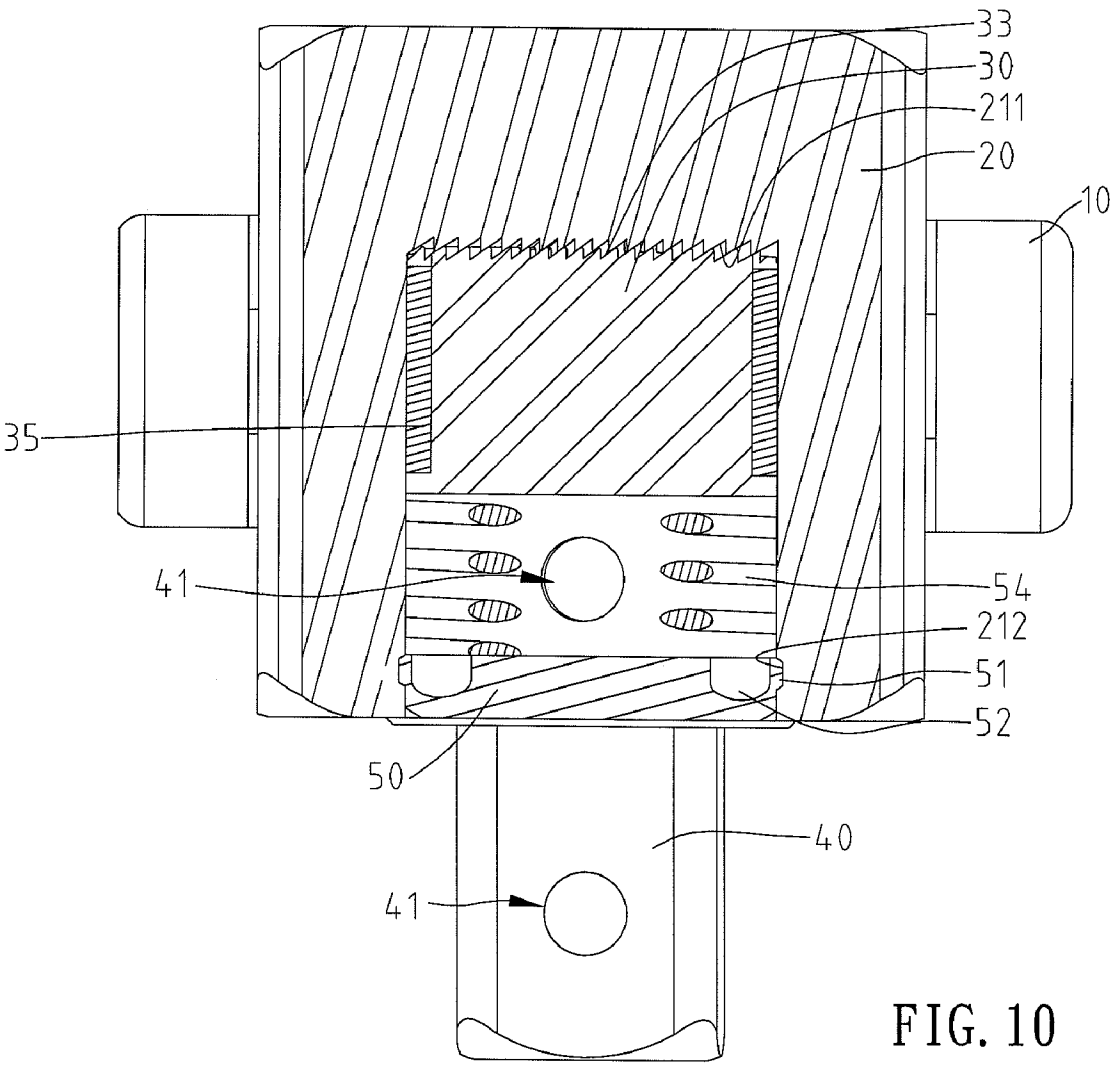
FIG. 10 is a cross-sectional view showing the first ratcheting mechanism is rotatable relative to the second ratcheting mechanism.

The driving device further includes a second ratcheting mechanism 30 rotatably engaged with the first ratcheting mechanism 20. In the preferred embodiment, the second ratcheting mechanism 30 is received in the compartment of the first ratcheting mechanism 20 and includes a first body section 301 received in the second compartment 22, and a second body section 302 received in the first compartment 21. Additionally, the first body section 301 has a first outer diametrical length, and the second body section 302 has a second outer diametrical length greater than the first outer diametrical length. Thus, the increased diametrical length in the second ratcheting mechanism 30 includes a second joining section interconnecting an outer periphery of the first body section 301 and an outer periphery of the second body section 302. Further, a plurality of second unsymmetrical teeth 33 are disposed on the second joining section and engaged with the first plurality of teeth 211, as best shown in FIGS. 9 and 10. Further, a seal ring 221 is disposed between the inner periphery of the second compartment 22 and the outer periphery of the first body section 301. Furthermore, a flange 34 is formed on the outer periphery of the second body section 302, and a bearing 35 is disposed between the inner periphery of the first compartment 21 and the outer periphery of the first body section 301 and is retained by the flange 34.

The second ratcheting mechanism 30 further includes a third body section 303 extended from the second body section 302 and received in the first compartment 21 of the first ratcheting mechanism 20. The third body section 303 has a third outer diametrical length less than the second outer diametrical length of the second body section 302. Further, a channel 31 extends in a longitudinal direction of the second ratcheting mechanism 30 and through the first, second, and third body sections 301, 302 and 303. Furthermore, a first aperture 32 and a second aperture 38 are defined on the first and third body sections 301 and 303, respectively, and each aperture 32 and 38 extends through the respective body sections 301 and 303 and is in communication with the channel 31.

Figure 8:
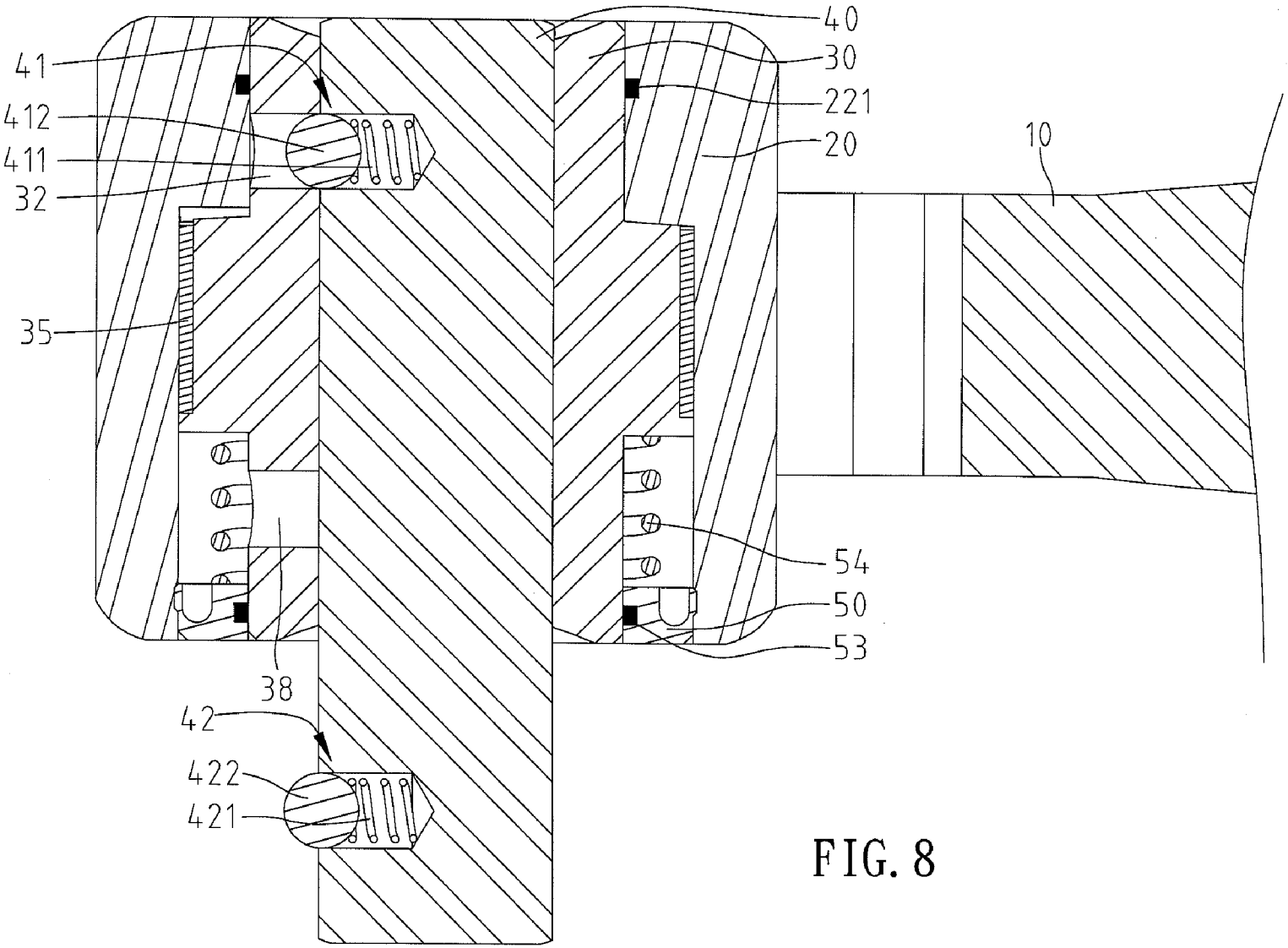
FIG. 8 is another cross-sectional view of the driving device, with the driving head retained in the first position.
Figure 11:
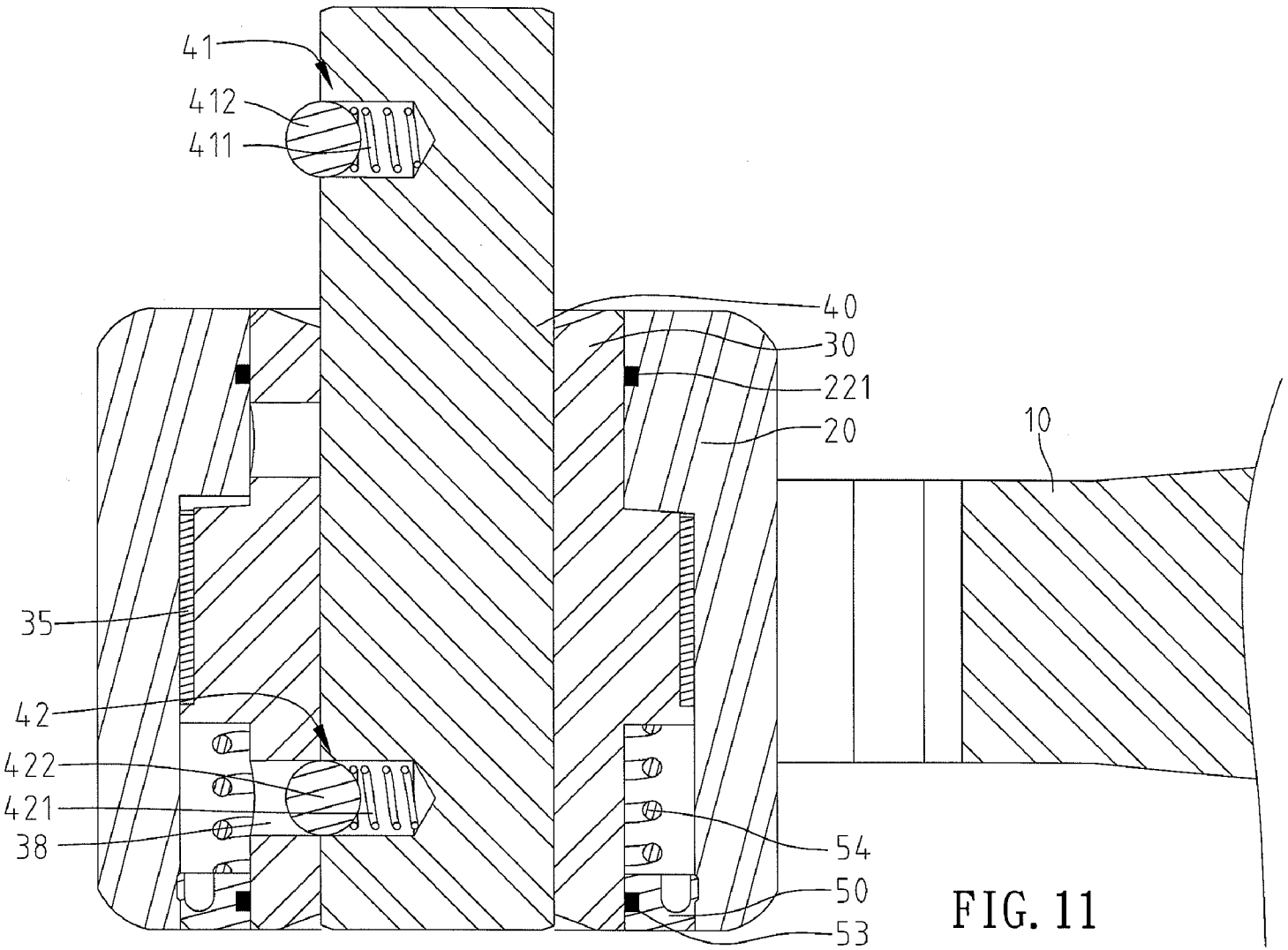
FIG. 11 is another cross-sectional view of the driving device, with the driving head retained in the second position.

The driving device further includes a driving head 40 having a shape corresponding to that of the channel 31 and is received in the channel 31. Additionally, the driving head 40 is adapted to be slidably moved in the channel 31 and is moveable between two releasably fixed positions, as shown in FIGS. 8 and 11. In the preferred embodiment, the driving head 40 includes a peripheral side having two locks 41 and 42 mounted thereon, the first lock 41 is in proximity to a first end of the driving head 40, and the second lock 42 is in proximity to a second end of the driving head 40. Additionally, the first lock 41 is engaged in the first aperture 32 on the first body section 301, and the second lock 42 is exposed outside the second ratcheting mechanism 30 when the driving head 40 is at one of the two fixed positions, as shown in FIG. 8. Also, the second lock 42 is engaged in the second aperture 38 on the third body section 303, and the first lock 41 is exposed outside the second ratcheting mechanism 30 when the driving head 40 is at the other of the two fixed positions, as shown in FIG. 11. In the preferred embodiment, each of the two locks 41 and 42 includes a resilient member 411 and 421 and a retainer 412 and 422 biasably moved by the resilient member 411 and 421 to engage in the first 32 and second 38 apertures respectively.

Figure 6:
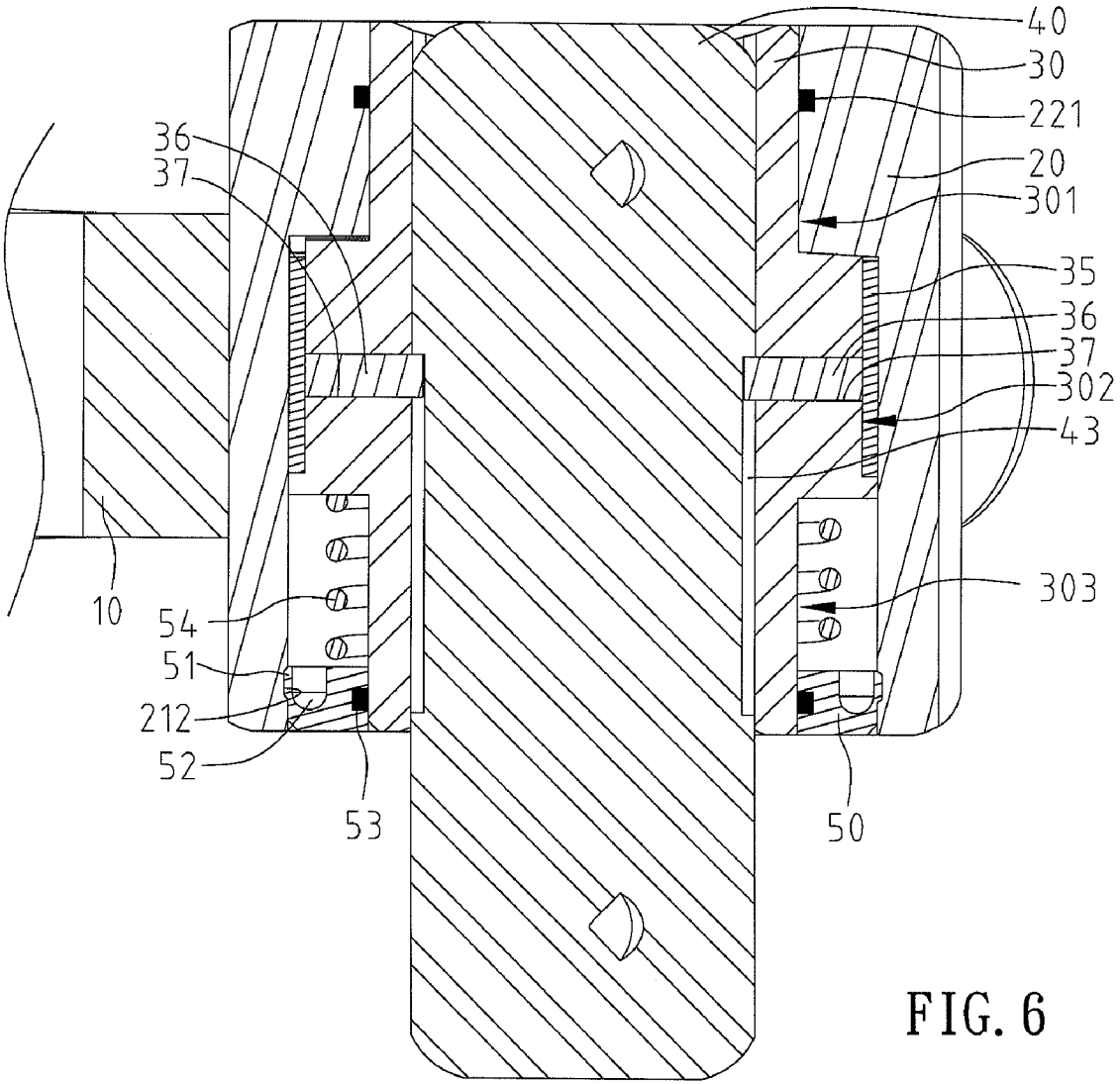
FIG. 6 is a cross-sectional view showing a driving head of the driving device retained in a first position.
Figure 7:
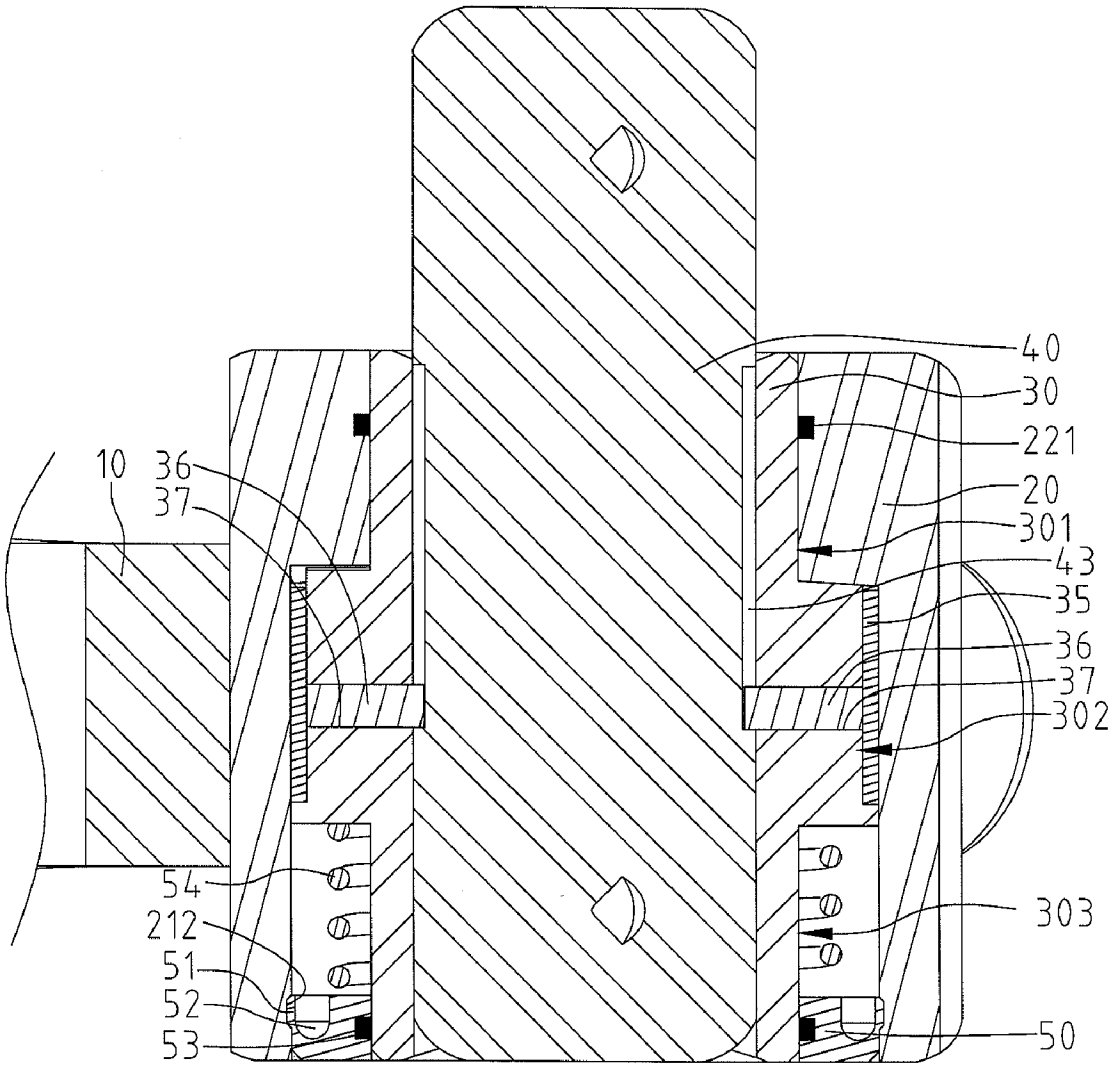
FIG. 7 is an extended view of FIG. 6 and shows the driving head retained in a second position.

The driving head 40 is prevented from siding out of the channel 31 of the second ratcheting mechanism 30. In the preferred embodiment, the driving head 40 includes a corner 44 interconnecting two peripheral sides thereof and a slot 43 extending in a longitudinal direction of the corner 44 and inset in the corner. The second body section 302 of the second ratcheting mechanism 30 includes a stopper 36 received in an orifice 37 which extends through the second body section 302 and is in communication with the channel 31, and the stopper 36 includes a first end retained by an inner peripheral side of the bearing 35 and a second end disposed in the channel 31 and retained in the slot 43 of the driving head 40, as shown in FIG. 6. Additionally, the slot 43 has a proximal end and a distal end separated by a first distance, and the two locks 41 and 42 are separated by a second distance greater than the first distance. The stopper 36 is retained by the proximal end of the slot 43 when the first lock 41 is releasably engaged in the aperture 32 on the first body section 301, and the second lock 42 is exposed outside the second ratcheting mechanism 30. Also, the stopper 36 is retained by the distal end of the slot 43 when the second lock 42 is releasably engaged in the aperture 32 on the first body section 301 and the first lock 41 is exposed outside the second ratcheting mechanism 30, as shown in FIG. 7. In the preferred embodiment, the driving head 40 may include two slots 43 which are disposed diagonally opposed to each other, and two stoppers 36 are utilized in the two slots 43, respectively.

Because the first and second pluralities of teeth 211 and 33 are unsymmetrical, the first ratcheting mechanism 20 is rotatable relative to the second ratcheting mechanism 30 in a single direction. Furthermore, when the first plurality of teeth 211 is rotated relative to the second plurality of teeth 33, one of the first plurality of teeth 211 is disengaged from one of the second plurality of teeth 33 and engages with a successive one of the plurality of teeth 33. In order to enable engagement of the plurality of first teeth 211 with the plurality of second teeth 33, an elastic member 54 is provided. In the preferred embodiment, the elastic member 54 is mounted on the third body section 303 of the second ratcheting mechanism 30 and is held between the second body section 302 of the second ratcheting mechanism 30 and an end cap 50. The end cap 50 is received in the first compartment 21 of the first ratcheting mechanism 20. Preferably, the first ratcheting mechanism 20 includes a notch 212, and the end cap 50 is retained in the notch 212 without the aid of a tool. Additionally, the end cap 50 includes a periphery 51 tight-fitted in the notch 212. The end cap 50 further includes an inner edge tight-fitted with an outer periphery of the third body section 303 of the second ratcheting mechanism 30. Further, a seal 53 is utilized between the inner edge of the end cap 50 and the outer periphery of the third body section 303. Furthermore, a groove 52 is defined between the periphery 51 and the inner edge of the end cap 50 to facilitate the end cap 50 to mount in the notch 212 of the first compartment 21 of the first ratcheting mechanism 20.

In use of the tool of the present invention, a user can connect a socket with the driving head 40 when the first lock 41 is releasably engaged in the first aperture 32 on the first body section 301 and the second lock 42 is exposed outside the second ratcheting mechanism 30. Thus, the driving head 40 and the socket are adapted to turn an element in a first direction.

Additionally, the driving head 40 is switchable to a mode that the second lock 42 is releasably engaged in the first aperture 32 on the third body section 303 and the first lock 41 is exposed outside the second ratcheting mechanism 30. Thus, the driving head 40 and the socket are adapted to turn an element in a second direction opposite to the first direction.

Based on the forgoing, it is an aspect of the present invention that the driving head 40 is switchable between a first mode with the driving head 40 adapted to turn an element in a first direction and a second mode with the tool adapted to enable the driving member to turn the element in a second direction opposite to the first direction.

It is another aspect of the present invention that the driving device is adapted to be pivoted and positioned at a selected pivoting position.

While the specific embodiments have been illustrated and described, numerous modifications come to mind without significantly departing from the spirit of invention, and the scope of invention is only limited by the scope of accompanying claims.

What is claimed is:

1. A tool comprising:

a shank including a first end and a second end;

a driving device mounted on the first end of the shank and including a first ratcheting mechanism having a compartment and a plurality of first unsymmetrical teeth in the compartment and including a second ratcheting mechanism rotatably received in the compartment and having a plurality of second unsymmetrical teeth engaged with the plurality of first teeth, with the compartment extending in a longitudinal direction of the first ratcheting mechanism and including a first compartment and a second compartment connected to and in communication with the first compartment, with the first compartment having a larger diametrical length than that of the second compartment, with the compartment further including a first joining section interconnecting respective inner peripheries of the first and second compartments, and with the plurality of first teeth disposed on the first joining section, with the first ratcheting mechanism being rotatable relative to the second ratcheting mechanism in a single direction, with the second ratcheting mechanism including a channel extending therein, a first body section received in the second compartment, a second body section received in the first compartment and a third body section extended from the second body section and received in the first compartment, with the first body section having a first outer diametrical length, with the second body section having a second outer diametrical length greater than the first outer diametrical length, with the third body section including a third outer diametrical length less than the second outer diametrical length of the second body section, with the second ratcheting mechanism further including a second joining section interconnecting respective outer peripheries of the first and second body sections, with the plurality of second teeth disposed on the second joining section;

a driving head having a shape corresponding to that of the channel and moveably received in the channel between two releasably fixed positions, with the driving head including a first lock and a second lock, with the first lock retained in a first aperture on the second ratcheting mechanism and the second lock exposed outside the second ratcheting mechanism when the driving head is at one fixed position, and with the second lock retained in a second aperture on the second ratcheting mechanism and the first lock exposed outside the second ratcheting mechanism when the driving head is at another fixed position;

a channel extending in a longitudinal direction of the second ratcheting mechanism and through the first, second, and third body sections, with the first aperture extending through the first body section and in communication with the channel, and with the second aperture extending through the third body section and in communication with the channel; and an elastic member retained by an end cap and the second ratcheting mechanism for biasing the plurality of second teeth to engage with the plurality of first teeth;

wherein the driving head is switchable between a first mode with the driving head adapted to turn an element in a first direction and a second mode with the tool adapted to enable the driving member to turn the element in a second direction opposite to the first direction; and wherein the driving head includes a corner interconnecting two peripheral sides thereof and a slot extending in a longitudinal direction of the corner and inset in the corner, wherein the second ratcheting mechanism includes a stopper received in an orifice which extends through the second ratcheting mechanism and is in communication with the channel, and with the stopper including a first end retained by an inner peripheral side of the bearing and a second end disposed in the channel and retained in the slot of the driving head.

2. The tool as claimed in claim 1 wherein the second body section includes a flange formed on the outer periphery thereof, and wherein the first and second ratcheting mechanisms include a bearing disposed therebetween and retained by the flange.

3. The tool as claimed in claim 1 wherein the channel has a shape corresponding to that of the driving head.

4. The tool as claimed in claim 1 wherein the slot has a proximal end and a distal end separated by a first distance, and wherein the first and second locks are separated by a second distance greater than the first distance.

5. The tool as claimed in claim 1 wherein the orifice extends through the second body section of the second ratcheting mechanism.

6. A tool comprising:

a shank including a first end and a second end;

a driving device mounted on the first end of the shank and including a first ratcheting mechanism having a compartment and a plurality of first unsymmetrical teeth in the compartment and including a second ratcheting mechanism rotatably received in the compartment and having a plurality of second unsymmetrical teeth engaged with the plurality of first teeth, with the first ratcheting mechanism being rotatable relative to the second ratcheting mechanism in a single direction, with the second ratcheting mechanism including a channel extending therein;

a driving head having a shape corresponding to that of the channel and moveably received in the channel between two releasably fixed positions, with the driving head including a first lock and a second lock, with the first lock retained in a first aperture on the second ratcheting mechanism and the second lock exposed outside the second ratcheting mechanism when the driving head is at one fixed position, and with the second lock retained in a second aperture on the second ratcheting mechanism and the first lock exposed outside the second ratcheting mechanism when the driving head is at another fixed position; and an elastic member retained by an end cap and the second ratcheting mechanism for biasing the plurality of second teeth to engage with the plurality of first teeth;

wherein the driving head is switchable between a first mode with the driving head adapted to turn an element in a first direction and a second mode with the tool adapted to enable the driving member to turn the element in a second direction opposite to the first direction; and wherein the first ratcheting mechanism includes a notch in the first compartment, wherein the end cap includes a periphery tight-fitted in the notch and an inner edge tight-fitted with the second ratcheting mechanism.

7. The tool as claimed in claim 6 wherein the first end of the shank includes two lugs separated by a space, wherein the driving device is pivotally clamped between the lugs within the space, wherein each lug includes a through hole and a pivot pin installed in the through hole, and wherein the first ratcheting mechanism includes an outer periphery having two peripheral surfaces opposed to each other and two cavities disposed on the two peripheral surfaces pivotally receiving the two pivot pins respectively.

8. The tool as claimed in claim 7 wherein the driving device is positioned at a selected pivoting position, wherein one of the two lugs and the first ratcheting mechanism includes a detent disposed thereon, and wherein another of the two lugs and the first ratcheting mechanism includes a plurality of recess on the outer periphery with which the detent is selectively engaged.

9. The tool as claimed in claim 8 wherein the plurality of recesses are radially disposed.

10. The tool as claimed in claim 8 wherein the detent includes an elastic element and a locking member biasably moved by the elastic element.

11. The tool as claimed in claim 6 wherein each of the first and second locks includes a resilient member and a retainer biasably moved by the resilient member to engage in the first and second apertures respectively.

12. The tool as claimed in claim 6 wherein the second end of the shank includes a hole adapted for receiving a driving tool, and wherein the shank is adapted to be used as a lever to drive the driving tool.

* * * * *